US008376524B2

(12) United States Patent
Lee et al.

(10) Patent No.: US 8,376,524 B2
(45) Date of Patent: Feb. 19, 2013

(54) THERMAL INKJET PRINTHEAD CHIP STRUCTURE AND MANUFACTURING METHOD FOR THE SAME

(75) Inventors: Francis Chee-Shuen Lee, Hsin-Chu (TW); Wei-Fu Lai, Hsin-Chu (TW); Ming-Ling Lee, Hsin-Chu (TW)

(73) Assignee: International United Technology Company, Ltd., Hsin-Chu (TW)

( * ) Notice: Subject to any disclaimer, the term of this patent is extended or adjusted under 35 U.S.C. 154(b) by 1142 days.

(21) Appl. No.: 12/249,120

(22) Filed: Oct. 10, 2008

(65) Prior Publication Data

US 2009/0141087 A1 Jun. 4, 2009

(30) Foreign Application Priority Data

Nov. 29, 2007 (TW) ..... 96145423 A

(51) Int. Cl.
*B41J 2/05* (2006.01)

(52) U.S. Cl. ..... 347/62

(58) Field of Classification Search ..... 347/61–62
See application file for complete search history.

(56) References Cited

U.S. PATENT DOCUMENTS

| | | | |
|---|---|---|---|
| 5,122,812 | A | 6/1992 | Hess et al. |
| 5,710,070 | A | 1/1998 | Chan |
| 5,774,148 | A | 6/1998 | Cornell et al. |
| 5,870,121 | A | 2/1999 | Chan |
| 7,216,961 | B2 | 5/2007 | Oikawa et al. |
| 7,267,430 | B2 | 9/2007 | Parish |
| 2002/0057314 | A1 | 5/2002 | Miyamoto et al. |
| 2004/0127021 | A1 | 7/2004 | Bell et al. |

FOREIGN PATENT DOCUMENTS

| | | | |
|---|---|---|---|
| EP | 0769379 | A1 | 4/1997 |
| EP | 1180434 | A1 | 2/2002 |
| EP | 1621347 | A2 | 2/2002 |
| TW | 362072 | | 6/1999 |
| TW | 503179 | B | 9/2002 |
| TW | 200503120 | A | 12/2003 |
| TW | 20063773 | A | 11/2006 |

*Primary Examiner* — Jerry Rahll
(74) *Attorney, Agent, or Firm* — Chun-Ming Shih

(57) ABSTRACT

A thermal inkjet printhead chip structure includes a substrate, an oxide layer formed on the substrate, at least one driver circuitry each including a source, a drain and a gate and formed on the substrate and further surrounded by the oxide layer, a dielectric layer, a buffer layer, a resistive layer and a conductive layer. The dielectric layer is formed on the driver circuitry and has openings formed therethrough to expose the source and drain. The buffer layer is formed on the dielectric layer, covering the source and drain and connected to the source and drain. The resistive layer is formed on the buffer layer and has at least one heating area. The resistive layer extends above the source and drain and is connected to the source and drain. The conductive layer is formed on the resistive layer and exposes the heating area. A manufacturing method also is provided.

18 Claims, 6 Drawing Sheets

THERMAL INKJET PRINTHEAD CHIP STRUCTURE AND MANUFACTURING METHOD FOR THE SAME

BACKGROUND OF THE INVENTION

1. Field of Invention

The present invention generally relates to an inkjet printhead chip structure and a manufacturing method for the same and, particularly to a thermal inkjet printhead chip structure that can buffer against a transient high temperature generated by a resistive layer thereof and a manufacturing method for the same.

2. Description of the Related Art

Various kinds of thermal inkjet printhead chip structures have been developed. For example, a thermal inkjet printhead chip structure as disclosed by U.S. Pat. No. 5,122,812 (the disclosure of which is incorporated herein by reference) includes a driver circuitry formed on a substrate and an insulating oxide layer, and a resistive layer formed on the substrate and directly electrically connected to a source and a drain of the driver circuitry. A conductive metal layer then is formed on the portions of the resistive layer. The area of the resistive layer that is not covered by the conductive layer functions as a heating area. The heating area of the thermal inkjet printhead chip structure would instantly generate an extremely high temperature when the driver circuitry is in operation, which would result in the substrate and the insulating oxide layer underneath the heating area becoming cracked. Such a phenomenon is termed as thermal shock and would shorten the life span of the thermal inkjet printhead chip structure.

U.S. Pat. No. 5,710,070 and U.S. Pat. No. 5,870,121 both disclose another type of thermal inkjet printhead chip structure, the disclosures of which are incorporated herein by references. Specifically, a resistive layer is formed on a dielectric layer. The resistive layer is comprised of two layers. The first layer of the resistive layer is made of metal and acts as a barrier between the dielectric layer underneath the first layer and the second layer and further can improve the electrical conductivity. Since the first layer acting as the barrier is made of metal with excellent thermal conductivity, the thermal shock suffered by the dielectric layer still does not be relieved, so that the life span of the thermal inkjet printhead chip structures is shortened.

U.S. Pat. No. 5,774,148 discloses still another type of thermal inkjet printhead chip structure, the disclosure of which is incorporated herein by reference. In particular, a boron-phosphorus doped silicate glass (BPSG) material is formed between a resistive layer and a silicon dioxide layer. The BPSG material has a serious stress issue, so that the BPSG material would more easily become cracked when encountering a high temperature generated by the resistive layer in operation. Therefore, the lift span of the thermal inkjet printhead chip structure would be severely influenced.

SUMMARY OF THE INVENTION

One objective of the present invention is to provide a thermal inkjet printhead chip structure that can buffer against a transient high temperature generated by a resistive layer thereof and decrease a thermal shock suffered by a dielectric layer underneath a heating area of the resistive layer, so that the life span of the thermal inkjet printhead chip structure can be increased.

Another objective of the present invention is to provide a manufacturing method for a thermal inkjet printhead chip structure to have a buffer layer formed between a dielectric layer and a resistive layer of the thermal inkjet printhead chip structure so as to decrease a thermal shock suffered by the dielectric layer underneath a heating area of the resistive layer, and therefore the life span of the thermal inkjet printhead chip structure would be increased.

Other objectives, features and advantages of the present invention will be further understood from the further technology features disclosed by the embodiments of the present invention wherein there are shown and described preferred embodiments of this invention, simply by way of illustration of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

In order to achieve one, some or all of the aforementioned objects or other objects, a thermal inkjet printhead chip structure in accordance with an embodiment of the present invention is provided. The thermal inkjet printhead chip structure includes a substrate, an oxide layer, at least one driver circuitry, a dielectric layer, a buffer layer, a resistive layer and a conductive layer. The at least one driver circuitry each includes a source, a drain and a gate. The oxide layer is formed on the substrate. The at least one driver circuitry is formed on the substrate and surrounded by the oxide layer. The dielectric layer is formed on the at least one driver circuitry and has a plurality of openings formed therethrough to expose the source and the drain. The buffer layer is formed on the dielectric layer and covers the source and the drain. The buffer layer is electrically connected to the source and the drain. The resistive layer is formed on the buffer layer and has at least one heating area. The resistive layer extends above the source and the drain and is electrically connected to the source and the drain through the buffer layer. The conductive layer is formed on the resistive layer and partially covered the resistive layer and thereby exposes the at least one heating area.

In one embodiment, the thermal inkjet printhead chip structure further includes a protective layer covering above the conductive layer and the at least one heating area.

In one embodiment, the at least one driver circuitry each is a metal-oxide-semiconductor field effect transistor (MOSFET).

In one embodiment, the openings include a first contact opening and a second contact opening. The drain and the source are respectively exposed at the first contact opening and the second contact opening. The buffer layer covers the drain and the source at the first contact opening and the second contact opening. The resistive layer is electrically connected to the drain and the source through the buffer layer at the first contact opening and the second contact opening.

In one embodiment, the material of the dielectric layer comprises one of a polyethylene oxide, a phosphosilicate glass and a borophosphosilicate glass.

In one embodiment, the material of the buffer layer comprises one of titanium nitride (TiN) and tungsten nitride (WN).

In one embodiment, the material of the resistive layer comprises one of tantalum aluminide (TaAl) and Hafnium Boride ($HfB_2$).

In one embodiment, the buffer layer and the resistive layer both are interrupted at a location directly above the gate.

In one embodiment, the material of the conductive layer comprises one of copper (Cu), gold (Au), aluminum (Al) and an aluminum-copper alloy.

In one embodiment, the at least one heating area each has a length in the range from 10 to 100 micrometers and a width in the range from 10 to 100 micrometers.

In one embodiment, a power density of the buffer layer at the at least one heating area is far smaller than a power density of the resistive layer at the at least one heating area.

In one embodiment, a resistance coefficient of the buffer layer at the at least one heating area is far larger than a resistance coefficient of the resistive layer at the at least one heating area.

In one embodiment, the resistance coefficient of the buffer layer at the at least one heating area is larger than or equal to 1.5 to 15 times of the resistance coefficient of the resistive layer at the at least one heating area.

In one embodiment, the sum of contact resistances of portions of the buffer layer and the resistive layer directly above each of the at least one driver circuitry is smaller than or equal to 3 percentage of the resistance of the resistive layer at each of the at least one heating area.

In one embodiment, the resistance coefficient of the resistive layer at the at least one heating area is in the range from 2.0 to 5.0 ohm-micrometers (Ω-μm), the resistance coefficient of the buffer layer at the at least one heating area is in the range from 6.5 to 75 ohm-micrometers, a thickness of the resistive layer at the at least one heating area is in the range from 100 to 2,000 angstroms and a thickness of the buffer layer at the at least one heating area is in the range from 100 to 2,000 angstroms.

In one embodiment, the resistive layer is formed immediately above the buffer layer and whereby an entire bottom of the resistive layer is covered by the buffer layer.

A manufacturing method for a thermal inkjet printhead chip structure in accordance with another embodiment of the present invention is provided. The manufacturing method includes the steps of: (a) providing a substrate, the substrate having an oxide layer and at least one driver circuitry formed thereon, the at least one driver circuitry each including a source, a drain and a gate; (b) forming a dielectric layer on the at least one driver circuitry, the dielectric layer covering the oxide layer, the source, the drain and the gate; (c) removing portions of the dielectric layer directly above the drain and the source to form a first contact opening and a second contact opening, so that the drain and the source being exposed at the first contact opening and the second contact opening respectively; (d) forming a buffer layer on and covering the dielectric layer, the buffer layer covering the drain and the source at the first contact opening and the second contact opening; (e) forming a resistive layer on and covering the buffer layer, the resistive layer electrically connected to the drain and the source through the buffer layer at the first contact opening and the second contact opening; (f) removing portions of the buffer layer and the resistive layer directly above the gate, the buffer layer and the resistive layer both being interrupted at the location directly above the gate; and (g) forming a conductive layer on the resistive layer to partially cover the resistive layer, wherein at least one portion of the resistive layer uncovered by the conductive layer each functioning as a heating area.

In one embodiment, the manufacturing method further includes the step of: forming a protective layer above the conductive layer and the heating area.

In one embodiment, the at least one driver circuitry each is a metal-oxide-semiconductor field effect transistor (MOSFET).

In one embodiment, the step of removing portions of the dielectric layer directly above the source and the drain is performed by a masking process.

In one embodiment, the material of the dielectric layer comprises one of a polyethylene oxide, a phosphosilicate glass and a borophosphosilicate glass.

In one embodiment, the material of the buffer layer comprises one of titanium nitride (TiN) and tungsten nitride (WN).

In one embodiment, the material of the resistive layer comprises one of tantalum aluminide (TaAl) and Hafnium Boride ($HfB_2$).

In one embodiment, one masking and etching process is performed to simultaneously define the coverage areas of the buffer layer and the resistive layer, so that the buffer layer and the resistive layer both are interrupted at the location directly above the gate.

In one embodiment, a resistance coefficient of the resistive layer at the at least one heating area is in the range from 2.0 to 5.0 ohm micrometers (Ω-μm), a resistance coefficient of the buffer layer at the at least one heating area is in the range from 6.5 to 75 ohm micrometers, a thickness of the resistive layer at the at least one heating area is in the range from 100 to 2,000 angstroms and a thickness of the buffer layer at the at least one heating area is in the range from 100 to 2,000 angstroms.

In one embodiment, the resistive layer is formed immediately above the buffer layer and whereby an entire bottom surface of the resistive layer is covered by the buffer layer.

A thermal inkjet printhead chip structure in accordance with still another embodiment of the present invention is provided. The thermal inkjet printhead chip structure includes a substrate, an oxide layer, at least one driver circuitry, a dielectric layer, a buffer layer, a resistive layer, a conductive layer and a protective layer. The at least one driver circuitry each includes a source, a drain and a gate. The oxide layer is formed on the substrate. The at least one driver circuitry is formed on the substrate and surrounded by the oxide layer. The dielectric layer is formed on the at least one driver circuitry and has a plurality of openings formed therethrough to expose the source and the drain. The buffer layer is formed on the dielectric layer and covers the source and the drain and further is electrically connected to the source and the drain. The resistive layer is formed on the buffer layer and has at least one heating area. The resistive layer extends above the source and the drain and is electrically connected to the source and the drain through the buffer layer. A resistance coefficient of the buffer layer at the at least one heating area is far larger than a resistance coefficient of the resistive layer at the at least one heating area. The conductive layer is formed on the resistive layer and exposes the at least one heating area. The protective layer covers above the conductive layer and the at least one heating area.

In one embodiment, the resistance coefficient of the buffer layer at the at least one heating area is larger than or equal to 1.5 to 15 times of the resistance coefficient of the resistive layer at the at least one heating area.

In one embodiment, the sum of contact resistances of portions of the buffer layer and the resistive layer directly above each of the at least one driver circuitry is smaller than or equal to 3 percentages of the resistance of the resistive layer at each of the at least one heating area.

In one embodiment, the resistive layer is formed immediately above the buffer layer and an entire bottom of the resistive layer is covered by the buffer layer.

In one embodiment, the openings include a first contact opening and a second contact opening, the drain and the source are respectively exposed at the first contact opening and the second contact opening. The buffer layer covers the drain and the source at the first contact opening and the second contact opening. The resistive layer is electrically connected to the drain and the source through the buffer layer at the first contact opening and the second contact opening.

The above-mentioned embodiments of the present invention each applies a buffer layer between the dielectric layer and the resistive layer, which can buffer against a transient high temperature generated by the resistive layer and thereby decreases a thermal shock suffered by the dielectric layer underneath the at least one heating area. Accordingly, the lift span of the thermal inkjet printhead chip structure can be increased. The buffer layer and the resistive layer can be formed in a vacuum chamber for use with one time during a thin film process. The coverage areas of the buffer layer and the resistive layer then are simultaneously defined by one masking and etching process, so that the entire bottom of the resistive layer is covered by the buffer layer. Since the formation of the buffer layer and the resistive layer only need using a vacuum chamber for one time and one masking and etching process, the manufacturing cost can be greatly reduced.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In this regard, the drawings are only schematic and the sizes of components may be exaggerated for clarity. On the other hand, directional terminology, such as "top," "bottom," above," "underneath," etc., is used with reference to the orientation of the Figure(s) being described. As such, the directional terminology is used for purposes of illustration and is in no way limiting.

Figure 1:
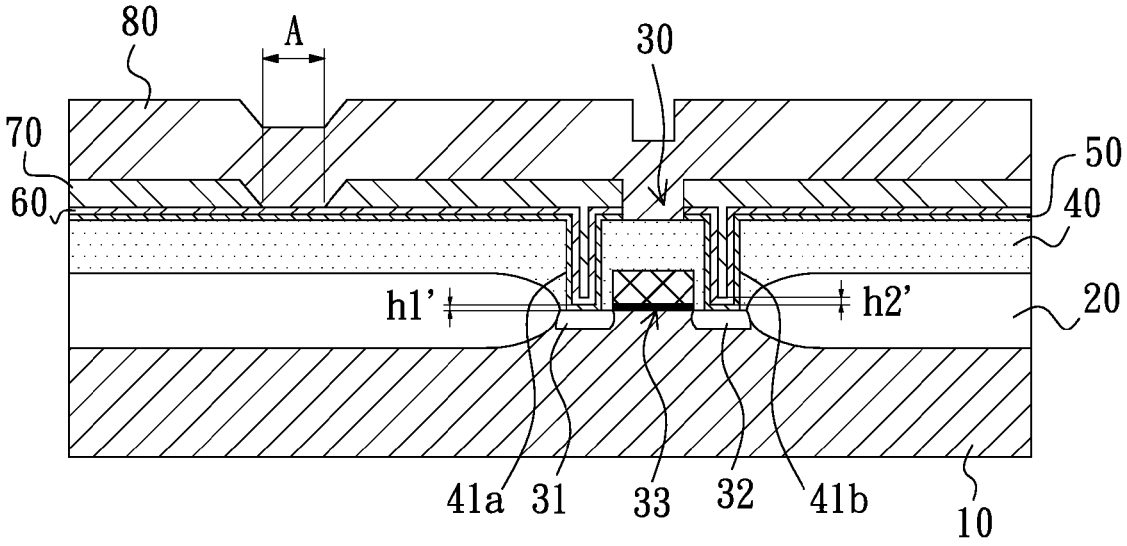
FIG. 1 is a schematic, cross-sectional view of a thermal inkjet printhead chip structure in accordance with an embodiment of the present invention.

FIG. 1 is a schematic, cross-sectional structural view of a thermal inkjet printhead chip structure in accordance with an embodiment of the present invention.

With reference to FIG. 1, the thermal inkjet printhead chip structure in accordance with the present embodiment includes a substrate 10, an oxide layer 20, at least one driver circuitry 30, a dielectric layer 40 formed on the at least one driver circuitry 30, a buffer layer 50, a resistive layer 60 formed on the buffer layer 50, and an electrically conductive layer 70 formed on and partially covering the resistive layer 60.

In one embodiment, the material of the substrate 10 can be silicon. A thickness of the substrate 10 can be in the range from 400 to 900 micrometers, typically is 675 micrometers. The oxide layer 20 can be a thermal oxide and formed on the top surface of the substrate 10 with a predetermined thickness by thermal oxidation. The predetermined thickness of the oxide layer 20 can be in the range from 0.5 to 1.5 micrometers, preferably is 1.1 micrometers.

With continued reference to FIG. 1, the at least one driver circuitry 30 is formed on the top surface of the substrate 10 and surrounded by the oxide layer 20. The number of the at least one driver circuitry 30 generally is multiple; FIG. 1 shows one driver circuitry 30 only for the purpose of illustration and is in no way limiting. The driver circuitry 30 can be an N-type metal-oxide-semiconductor field effect transistor (MOSFET) according to a preferred embodiment. The driver circuitry 30 includes a drain 31, a source 32 and a gate 33 for electrical connections with respective different components (will be described in detailed hereinafter). The technology for the formation of the driver circuitry 30 is well-known in the art and a lot of manufacturing methods also have been disclosed, and thus will not be described below in detail.

With continued reference to FIG. 1, the dielectric layer 40 has a plurality of openings formed therethrough to allow the drain 31 and the source 32 of the driver circuitry 30 to be exposed. The formation of the dielectric layer 40 can be performed by a thermal oxidation or a chemical vapor deposition (CVD) process. After the formation of the dielectric layer 40, portions of the dielectric layer 40 directly above the drain 31 and the source 32 are removed by a masking process to form a first contact opening 41*a* and a second contact opening 41*b* (i.e., the above-mentioned openings of the dielectric layer 40), so that the drain 31 and the source 32 are respectively exposed thereat. In one embodiment, the material of the dielectric layer 40 can be, for example, a polyethylene oxide, a phosphosilicate glass or a borophosphosilicate glass. A thickness of the dielectric layer 40 can be in the range from 1,000 to 10,000 angstroms, preferably is 8,000 angstroms.

With still reference to FIG. 1, in this embodiment, the buffer layer 50 is formed on the dielectric layer 40 and covers the drain 31 and the source 32 at the first contact opening 41*a* and the second contact opening 41*b*. A method for the formation of the buffer layer 50 can be, for example, a chemical vapor deposition (CVD) process. The material of the buffer layer 50 can be, for example, titanium nitride (TiN) or tungsten nitride (WN). A thickness of the buffer layer 50 can be in the range from 100 to 2,000 angstroms, preferably in the range from 400 to 1,000 angstroms.

In one embodiment, the material of the resistive layer 60 can be tantalum aluminide (TaAl) or Hafnium Boride ($HfB_2$). A thickness of the resistive layer 60 can be in the range from 100 to 2,000 angstroms, preferably in the range from 700 to 900 angstroms. According to a preferred embodiment, the buffer layer 50 and the resistive layer 60 both can be sequentially deposited over the dielectric layer 40 in a vacuum chamber for use with one time during a thin film process, the coverage areas of the buffer layer 50 and the resistive layer 60 then are simultaneously defined by use of one masking and etching process and thereby previous continuous buffer layer 50 and resistive layer 60 are cut off at the locations directly above the gate 33. Therefore, the buffer layer 50 and the resistive layer 60 both are interrupted at the location directly above the gate 33. In particular, according to a preferred embodiment, the resistive layer 60 is formed immediately above the buffer layer 50 and the entire bottom of the resistive layer 60 has the buffer layer 50, the resistive layer 60 even extends over the drain 31 and the source 32 and is electrically connected to the drain 31 and the source 32 through the buffer layer 50 at the first contact opening 41*a* and the second contact opening 41*b*. Therefore, the buffer layer 50 can be made of an electrically conductive material.

With still reference to FIG. 1, the electrically conductive layer 70 is formed on the resistive layer 60. The electrically conductive layer 70 does not completely cover the entire resistive layer 60. The uncovered area A (FIG. 1 only illustrates one uncovered area for the purpose of illustration) of the resistive layer 60 functions as a heating area of the inkjet printhead chip structure. In other words, the electrically conductive layer 70 is partially formed on the resistive layer 60 and thereby exposes the heating area A. The heating area A of the resistive layer 60 is used to provide heat to an ink so as to heat the ink. The material of the electrically conductive layer 70 can be copper (Cu), gold (Au), aluminum (Al) or an aluminum-copper alloy (AlCu), and preferably is an aluminum-copper alloy.

With still reference to FIG. 1, the thermal inkjet printhead chip structure can further includes a protective layer 80 formed on the conductive layer 70 and the heating area A. The material of the protective layer 80 can be silicon nitride (SiN), silicon oxide (SiO), silicon carbide (SiC) or a laminated SiN and SiC. A thickness of the protective layer 80 can be in the range from 1,000 to 20,000 angstroms, and preferably in the range from 5,000 to 10,000 angstroms.

Figure 2:
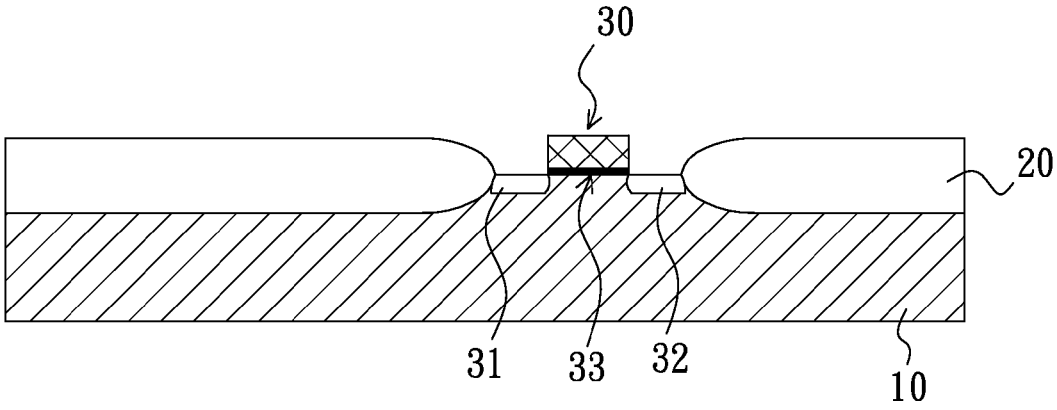
FIGS. 2 through 9 show steps of a manufacturing method for a thermal inkjet printhead chip structure in accordance with an embodiment of the present invention.
Figure 3:
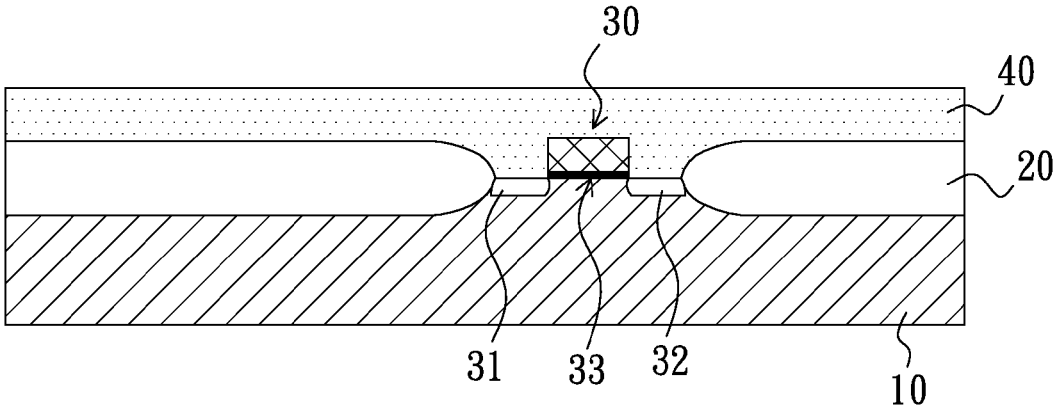

With reference to FIGS. 2 through 9, a manufacturing method for a thermal inkjet printhead chip structure in accordance with a preferred embodiment is illustrated. Referring to FIG. 2, a substrate 10 is firstly provided. An oxide layer 20 and at least one driver circuitry 30 (FIG. 2 only shows one driver circuitry 30 for the purpose of illustration) are formed on the substrate 10, the driver circuitry 30 is surrounded by the oxide layer 20. The driver circuitry 30 each includes a drain 31, a source 32 and a gate 33. Referring to FIG. 3, after the formation of the driver circuitry 30, a dielectric layer 40 is formed on the driver circuitry 30. The dielectric layer 40 completely covers the oxide layer 20 and the drain 31, the source 32 and the gate 33 of the driver circuitry 30.

Figure 4:
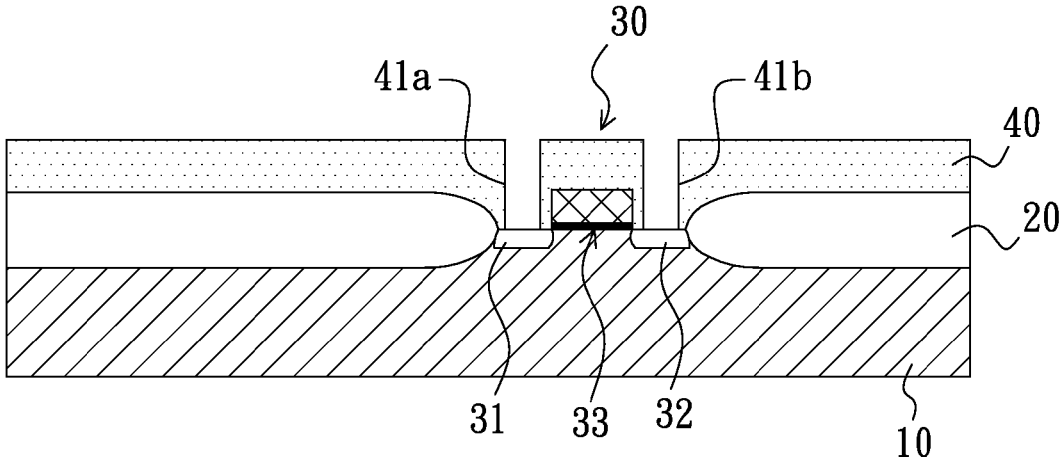

Referring to FIG. 4, a first contact opening 41*a* and a second contact opening 41*b* are formed through the dielectric layer 40. The formation of the first contact opening 41*a* and the second contact opening 41*b* can be performed by a masking process to remove selected portions of the dielectric layer 40 directly above the drain 31 and the source 32, so that the drain 31 and the source 32 are respectively exposed at the first contact hole 41*a* and the second contact hole 41*b*. It is indicated that the description in accordance with the present embodiment regarding "the drain and the source are respectively exposed at the first contact opening and the second contact opening" or the like does not mean that there is no other material covering the drain 31 and the source 32 at the first contact opening 41*a* and the second contact opening 41*b*, but to express the drain 31 and the source 32 are not covered by the dielectric layer 40 at the first contact opening 41*a* and the second contact opening 41*b* due to the existence of the first contact opening 41*a* and the second contact opening 41*b*.

Figure 5:
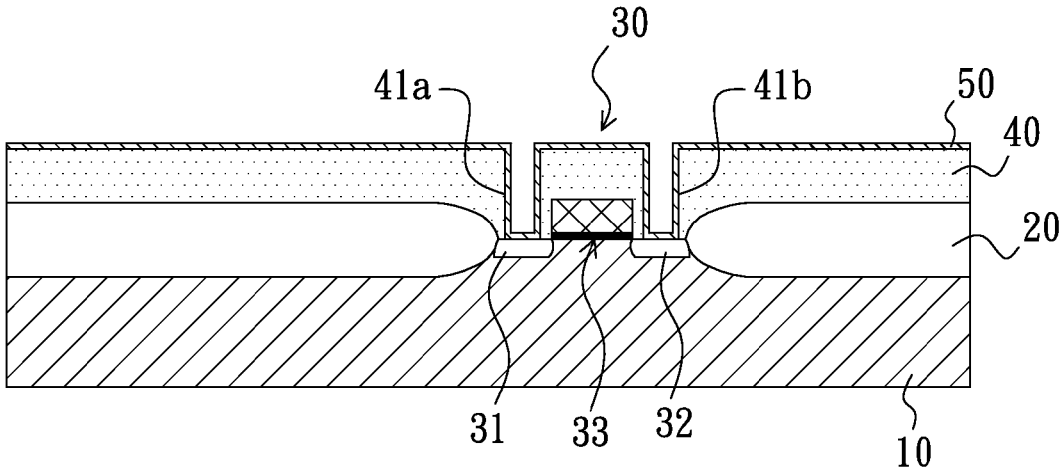
Figure 6:
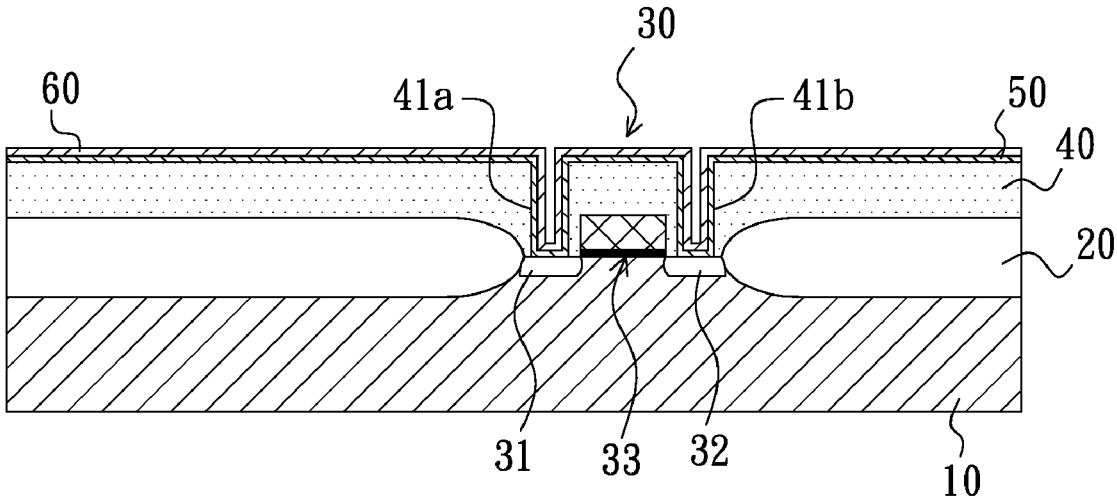

Referring to FIG. 5, after the formation of the first contact opening 41*a* and the second contact opening 41*b*, a buffer layer 50 is formed on the dielectric layer 40. The buffer layer 50 completely covers the dielectric layer 40 and the drain 31 and the source 32 at the first contact opening 41*a* and the second contact opening 41*b*. In other words, the buffer layer 50 is electrically connected to the drain 31 and the source 32 at the first contact opening 41*a* and the second contact opening 41*b*. Referring to FIG. 6, after the formation of the buffer layer 50 on the dielectric layer 40, a resistive layer 60 is formed on the buffer layer 50. The resistive layer 60 completely covers over the buffer layer 50.

Figure 7:
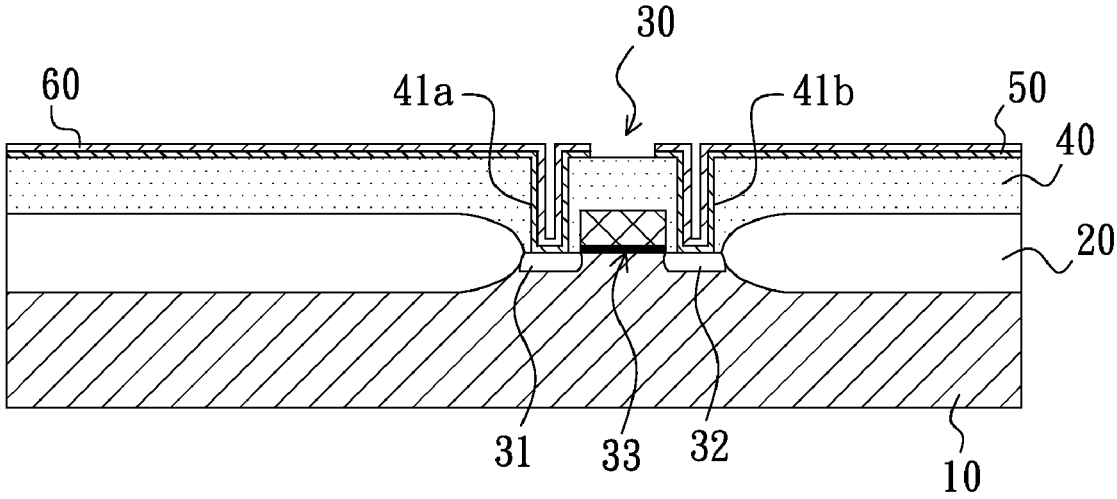

Referring to FIG. 7, after the formation of the resistive layer 60 over the buffer layer 50, selected portions of the buffer layer 50 and the resistive layer 60 directly above the gate 33 are subsequently removed. The removing step can be performed by one single masking and etching process to simultaneously define the coverage areas of the buffer layer 50 and the resistive layer 60 and thereby the previous continuous buffer layer 50 and the resistive layer 60 are cut off or interrupted at the location directly above the gate 33.

Figure 8:
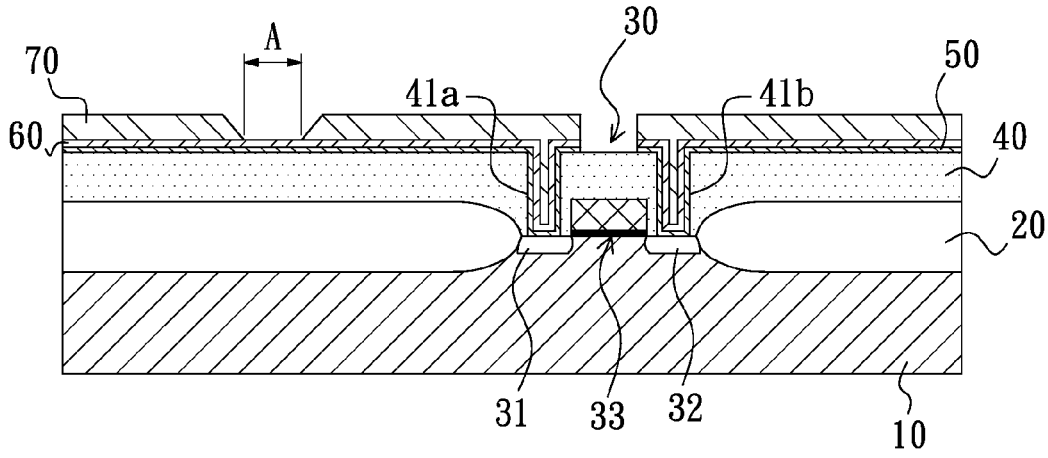
Figure 9:
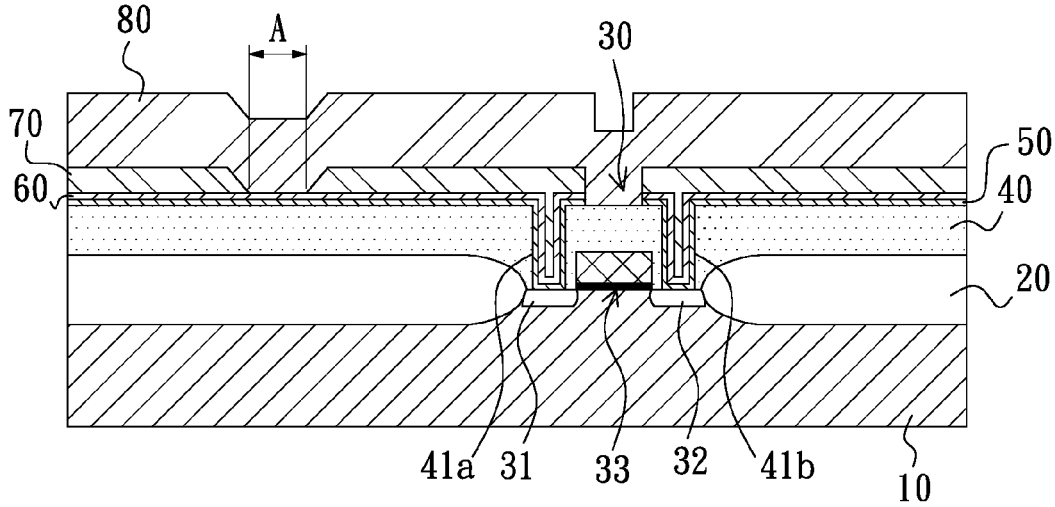

Referring to FIG. 8, after the coverage areas of the buffer layer and the resistive layer 60 are simultaneously defined, a conductive layer 70 is partially formed on the resistive layer 60. In other words, the conductive layer 70 does not completely cover the entire resistive layer 60, at least one uncovered area A (FIG. 8 only show one uncovered area for the purpose of illustration) of the resistive layer 60 that is not covered by the conductive layer 70 functions as a heating area A of the inkjet printhead chip structure. Referring to FIG. 9, in order to avoid an ink to corrode the layers underneath the ink (not shown), a protective layer 80 can be formed on the conductive layer 70 and the heating area A.

In the manufacturing method in accordance with the preferred embodiment, the formation of the buffer layer 50 and the resistive layer 60 can be performed only using a vacuum chamber one time and one masking and etching process, so that the manufacturing cost can be greatly reduced.

The thermal inkjet printhead chip structures in accordance with the above-mentioned embodiments of the present invention each use the at least one heating area A of the resistive layer 60 to generate a high temperature to allow an ink instantly to generate bubble and pressure, so that the ink droplet can be jet-printed on a printing media. The buffer layer 50 is used to buffer against the transient high temperature (generally about 300 to 500 Celsius degrees) generated by the at least one heating area A, so as to protect the dielectric layer 40 underneath the at least one heating area A from being cracked and avoid the reduction of the life span of the inkjet printhead chip structure. Accordingly, the temperature encountered by the dielectric layer 40 underneath the buffer layer 50 is much lower than the transient high temperature generated by the at least one heating area A.

In order to make the thermal energy generated from the buffer layer 50 to be much lower than the thermal energy generated by the at least one heating area A of the resistive layer 60, in a preferred embodiment, designs for related components based upon a relationship between power densities of the buffer layer 50 and resistive layer 60 are proposed. Detailed descriptions will be given below with reference to FIG. 10.

Figure 10:
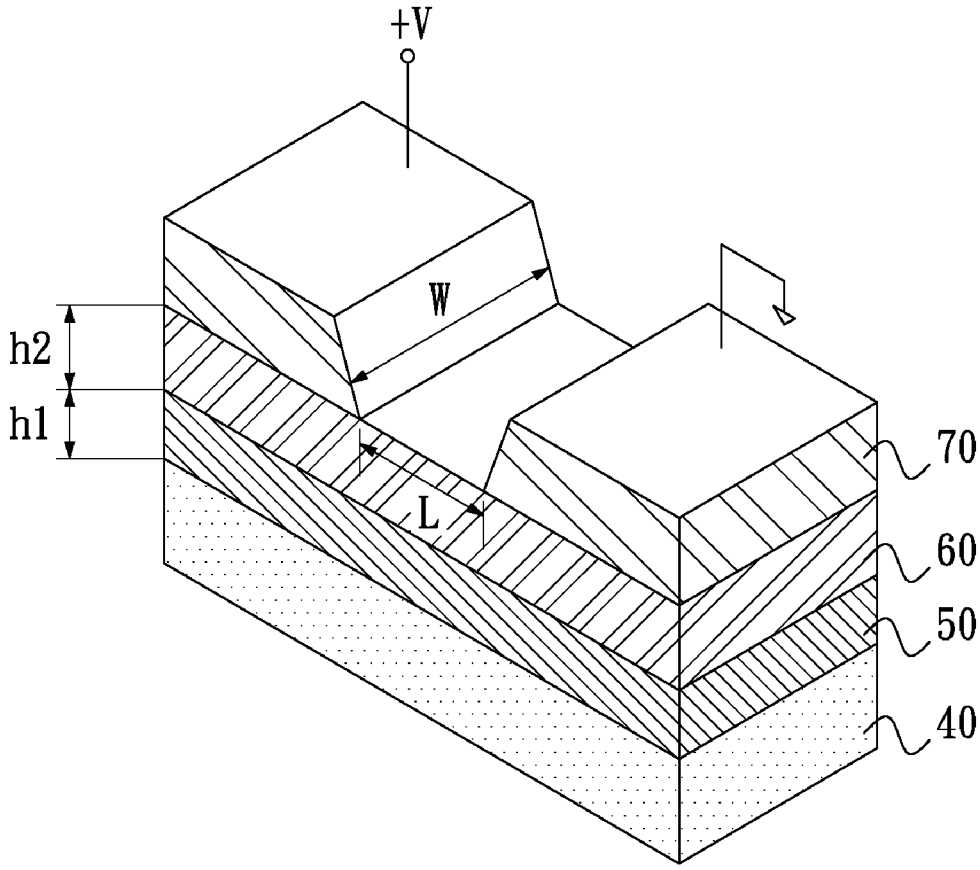
FIG. 10 is a schematic, cross-sectional view of a heating area in accordance with an embodiment of the present invention.

FIG. 10 is a schematic, cross-sectional structural view of a heating area A of a thermal inkjet printhead chip structure in accordance with an embodiment of the present invention. A thickness of the buffer layer 50 is h1 and a thickness of the resistive layer 60 is h2. Assuming that a voltage difference at the heating area A is +V, a length and a width of the heating area A respectively are L and W, a power density (hereinafter abbreviated as "PD") of the buffer layer 50 at the heating area A (i.e., generally a power density of a portion of the buffer layer 50 directly underneath (corresponding to) the heating area A) and a power density of the resistive layer 60 at the heating area A can be calculated according to equation (1), wherein L is the length of the heating area A, W is the width of the heating area A, h is the thickness of the resistive layer 60 or the buffer layer 50, and R is the resistance of the resistive layer 60 at the heating area A or the buffer layer 50 at the heating area A. In order to reduce the temperature encountered by the dielectric layer 40 at the heating area A (i.e. the temperature of the dielectric layer 40 underneath the heating area A), it is necessary to limit the power density PD1 (referring to equation (2)) of the buffer layer 50 at the heating area A to be far smaller than the power density PD2 (referring to equation (3)) of the resistive layer 60 at the heating area A, so that the temperature of the buffer layer 50 is lower than that of the resistive layer 60 when the thermal inkjet printhead chip structure is in operation.

$$PD = \frac{\frac{V^2}{R}}{L \times W \times h} \tag{1}$$

$$PD1 = \frac{\frac{V^2}{R1}}{L \times W \times h1} = \frac{V^2}{L \times W \times h1 \times R1} \tag{2}$$

$$PD2 = \frac{\frac{V^2}{R2}}{L \times W \times h2} = \frac{V^2}{L \times W \times h2 \times R2} \tag{3}$$

The R1 or R2 can be expressed as equation (4), wherein a is a resistance coefficient of the resistive layer 60 or the buffer layer 50. By introducing the equation (4) into the equation (2) and the equation (3) respectively, equation (5) and equation (6) listed below are correspondingly obtained.

$$R = \frac{\sigma}{h} \times \frac{L}{W} \tag{4}$$

$$PD1 \Rightarrow \frac{V^2}{L^2\sigma 1} \tag{5}$$

$$PD2 \Rightarrow \frac{V^2}{L^2\sigma 2} \tag{6}$$

In order to assure a temperature of the buffer layer 50 in operation is lower than that of the resistive layer 60, the power density PD2 of the resistive layer 60 is necessary to be far larger than the power density PD1 of the buffer layer 50, a relative relationship between the PD1 and the PD2 is expressed as equation (7).

$$PD2 >> PD1 \Rightarrow \frac{V^2}{L^2\sigma 2} >> \frac{V^2}{L^2\sigma 1} \tag{7}$$

Assuming that the voltage differences V and lengths L of the buffer layer 50 and the resistive layer 60 at the heating area A are the same, the equation (7) becomes as equation (8) as follow.

$$\sigma 1 >> \sigma 2 \tag{8}$$

From equation (8), it is found that in order to assure the power density PD2 of the resistive layer 60 is far larger than the power density PD1 of the buffer layer 50, the resistance coefficient G1 of the buffer layer 50 at the heating area A (i.e. the resistance coefficient σ1 of the buffer layer 50 underneath (corresponding to) the heating area A) is necessary to be far larger than the resistance coefficient σ2 of the resistive layer 60 at the heating area A. In order to choose materials satisfying the equation (8), in a preferred embodiment, the equation (8) can be expressed as equation (9) as follows, so as to conform to the resistance coefficient characteristics of available materials in semiconductor factories.

$$\sigma 1 \geqq x\sigma 2; x = 1.5 \sim 15 \tag{9}$$

Figure 11:
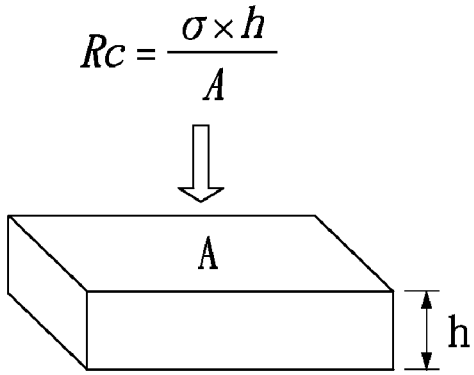
FIG. 11 shows a calculation model for contact resistance in accordance with an embodiment of the present invention.

By controlling the power densities of the buffer layer 50 and the resistive layer 60 at the heating area A so as to limit the resistance coefficient of the buffer layer 50 at the heating area A to be preferably larger than or equal to 1.5 to 15 times of the resistance coefficient of the resistive layer 60 at the heating area A so that the temperature of the buffer layer 50 in operation is lower than that of the resistive layer 60, in another preferred embodiment, contact resistances of portions of the buffer layer 50 and the resistive layer 60 directly above the drain 31 and the source 32 of the driver circuitry 30 at the first contact opening 41*a* and the second contact opening 41*b* can also be limited, so as to avoid the loss of a signal outputted from the drain 31 or the source 32 resulting from excessive high contact resistances. A method for calculating a value Rc of contact resistance and a calculation model is illustrated in FIG. 11. FIG. 11 shows contact resistance Rc=((σ×h)/A). By introducing the thicknesses h1' and h2' of the buffer layer 50 and the resistive layer 60 respectively illustrated in FIG. 1 into equation Rc=((σ×h)/A), the equation (10) as follows can be obtained. In the equation (10), Rc1 is the value of contact resistance of the portion of the buffer layer 50 directly above the driver circuitry 30, and Rc2 is the value of contact resistance of the portion of the resistive layer 60 directly above the driver circuitry 30.

$$Rc1 = \frac{\sigma 1 \times h1'}{A}; Rc2 = \frac{\sigma 2 \times h2'}{A} \tag{10}$$

It is found from FIG. 1, the first contact opening 41*a* and the second contact opening 41*b* respectively located above the drain 31 and the source 32 are covered by the buffer layer 50 and the resistive layer 60 and allow signals to be transmitted out. The covered thickness of the first contact opening 41*a* and the second contact opening 41*b* is equal to h1'+h2'. h1' is the thickness of the buffer layer 50 filled in the first contact opening 41*a* and the second contact opening 41*b*, h2' is the thickness of the resistive layer 60 filled in the first contact opening 41 a and the second contact opening 41*b*. In a typical semiconductor process, the thickness of a material deposited in a contact opening would be approximately equal to or less than the thickness of the material deposited on a flat surface due to a shadow effect. Accordingly, in a preferred embodiment, the thickness of h1' is approximately equal to 0.9 times of the thickness of h1, the thickness of h2' is approximately equal to 0.9 times of the thickness of h2. As can be seen from FIG. 1, the buffer layer 50 is directly connected to the drain 31 and the source 32 at the first contact opening 41*a* and the second contact opening 41*b* respectively, and the resistive layer 60 covers on the buffer layer 50. In order to avoid the loss of a signal outputted from the drain 31 or the source 32 resulting from excessive high contact resistances, it is necessary to limit the contact resistances of portions of the buffer layer 50 and the resistive layer 60 directly above the driver circuitry 30. According to a preferred embodiment, the sum of Rc1 and Rc2 of contact resistances is preferably smaller than or equal to 3 percentages of the resistance R_Heater of the resistive layer 60 at the heating area A (referring to equation (11)). That is to say, if the R_Heater is 30 ohms (Ω), the sum of Rc1 and Rc2 is preferably smaller than or approximately equal to 0.9 ohms.

$$\frac{\sigma 1 \times h1'}{A1} + \frac{\sigma 2 \times h2'}{A2} \leq 3\% \times \text{R_Heater} \tag{11}$$

Accordingly, when the equation (9) and the equation (11) both are satisfied, the temperature of the buffer layer 50 at the heating area A is lower than the transient high temperature of the resistive layer 60 at the heating area A, the temperature suffered by the dielectric layer 40 at the heating area A is lowered and the contact resistances of the drain 31 and the source 32 of the driver circuitry 30 are reduced. Therefore, the thermal inkjet printhead chip structure in accordance with an embodiment of the present invention can buffer against the transient high temperature generated by the resistive layer 60 in operation and suffered by the dielectric layer 40 underneath the heating area A by the use of the buffer layer 50, the possibility of the dielectric layer 40 becoming cracked resulting from the transient high temperature can be reduced and therefore the life span of the thermal inkjet printhead chip structure can be increased.

According to the foregoing description, related conditions for the components or portions of the thermal inkjet printhead chip structure in accordance with a preferred embodiment are listed in table 1. The parameters as follows refer to the size (L, W) and the resistance coefficient (σ) of the heating area A of the resistive layer 60, the size (L, W) and the resistance coefficient (σ) of the buffer layer 50 at the heating area A, the areas and thicknesses (h') of the contact areas directly above the source 32 and the drain 31. It is indicated that these data are only for the purpose of illustration and in no way limiting.

TABLE 1

| Resistive layer/Buffer layer | Resistive layer at the heating area | Buffer layer at the heating area |
|---|---|---|
| Length L | 10~100 micrometers (μm) | 10~100 micrometers |
| Width W | 10~100 micrometers | 10~100 micrometers |
| Thickness h | 100~2000 angstroms | 100~2000 angstroms |
| Resistance coefficient | 2.0~5.0 (Ω-μm) | 6.5~75 (Ω-μm) |
| Material | TaAl or HfB2 | TiN or WN |
| **Resistive layer/Buffer layer** | **Resistive layer at the contact area** | **Buffer layer at the contact area** |
| Area | 0.01~100 square micrometers (μm2) | 0.01~100 square micrometers |
| Thickness h' | 90~1800 angstroms | 90~1800 angstroms |

It is noted that in the context of the present invention, the description "the resistance coefficient of the buffer layer 50 at the heating area A", "the power density of the buffer layer 50 at the heating area A" or other similar description means that the resistance coefficient or power density of the buffer layer 50 underneath (corresponding to) the heating area A. Similarly, the description "the temperature suffered by the dielectric layer 40 at the heating area A" or the like means that the temperature of the dielectric layer 40 underneath (corresponding to) the heating area A; the description "the length of the buffer layer at the heating area A" or "the width of the buffer layer at the heating area A" means that the length or the width of the buffer layer underneath (corresponding to) the heating area A.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A thermal inkjet printhead chip structure comprising:

a substrate;

an oxide layer formed on the substrate;

at least one driver circuitry formed on the substrate and surrounded by the oxide layer, the at least one driver circuitry each comprising a source, a drain and a gate;

a dielectric layer formed on the at least one driver circuitry, the dielectric layer having a plurality of openings formed therethrough to expose the source and the drain;

a buffer layer formed on the dielectric layer, the buffer layer covering and electrically connected to the source and the drain;

a resistive layer separate from the buffer layer formed on and above the buffer layer and having at least one heating area, the resistive layer extending above the source and the drain and electrically connected to the source and the drain through the buffer layer, wherein the resistive layer at least overlaps with the buffer layer on the heating area, wherein the at least one heating area each has a length ranging from 10 to 100 micrometers and a width ranging from 10 to 100 micrometers, and the resistance coefficient of the buffer layer at the at least one heating area is 1.5 to 15 times of the resistance coefficient of the resistive layer at the at least one heating area; and a conductive layer formed on the resistive layer and partially covered the resistive layer to expose the at least one heating area.

2. The thermal inkjet printhead chip structure as claimed in claim 1, further comprising a protective layer covering above the conductive layer and the at least one heating area.

3. The thermal inkjet printhead chip structure as claimed in claim 1, wherein the at least one driver circuitry each is a metal-oxide-semiconductor field effect transistor (MOSFET).

4. The thermal inkjet printhead chip structure as claimed in claim 1, wherein the openings comprise a first contact opening and a second contact opening, the drain and the source are respectively exposed at the first contact opening and the second contact opening, the buffer layer covers the drain and the source at the first contact opening and the second contact opening, the resistive layer is electrically connected to the drain and the source through the buffer layer at the first contact opening and the second contact opening.

5. The thermal inkjet printhead chip structure as claimed in claim 1, wherein the material of the dielectric layer comprises one of a polyethylene oxide, a phosphosilicate glass and a borophosphosilicate glass.

6. The thermal inkjet printhead chip structure as claimed in claim 1, wherein the material of the buffer layer comprises one of titanium nitride (TiN) and tungsten nitride (WN).

7. The thermal inkjet printhead chip structure as claimed in claim 1, wherein the material of the resistive layer comprises one of tantalum aluminide (TaAl) and Hafnium Boride (HfB2).

8. The thermal inkjet printhead chip structure as claimed in claim 1, wherein the buffer layer and the resistive layer both are interrupted at the location directly above the gate.

9. The thermal inkjet printhead chip structure as claimed in claim 1, wherein the material of the conductive layer comprises one of copper, gold, aluminum and an aluminum-copper alloy.

10. The thermal inkjet printhead chip structure as claimed in claim 1, wherein a power density of the buffer layer at the at least one heating area is far smaller than a power density of the resistive layer at the at least one heating area.

11. The thermal inkjet printhead chip structure as claimed in claim 1, wherein the sum of contact resistances of portions of the buffer layer and the resistive layer directly above each of the least one driver circuitry is smaller than or equal to 3 percentages of the resistance of the resistive layer at each of the at least one heating area.

12. The thermal inkjet printhead chip structure as claimed in claim 1, wherein the resistance coefficient of the resistive layer at the at least one heating area is in the range from 2.0 to 5.0 ohm-micrometers, the resistance coefficient of the buffer layer at the at least one heating area is in the range from 6.5 to 75 ohm-micrometers, a thickness of the resistive layer at the at least one heating area is in the range from 100 to 2,000 angstroms and a thickness of the buffer layer at the at least one heating area is in the range from 100 to 2,000 angstroms.

13. The thermal inkjet printhead chip structure as claimed in claim 1, wherein the sum of contact resistances of portions of the buffer layer and the resistive layer directly above each of the least one driver circuitry is smaller than or equal to 3 percentages of the resistance of the resistive layer at each of the at least one heating area.

14. The thermal inkjet printhead chip structure as claimed in claim 1, wherein the resistive layer is formed immediately above the buffer layer and an entire bottom of the resistive layer is covered by the buffer layer.

15. A thermal inkjet printhead chip structure comprising;

a substrate;

an oxide layer formed on the substrate;

at least one driver circuitry formed on the substrate and surrounded by the oxide layer, the at least one driver circuitry each comprising a source, a drain and a gate;

a dielectric; layer formed on the at least one driver circuitry and having a plurality of openings formed therethrough to expose the source and the drain;

a buffer layer formed on the dielectric layer and covering the source and the drain, the buffer layer electrically connected to the source and the drain;

a resistive layer separate from the buffer layer formed on and above the buffer layer and having at least one heating area, the resistive layer extending above the source and the drain and electrically connected to the source and the drain through the buffer layer, a resistance coefficient of the buffer layer at the at least one heating area being far larger than a resistance coefficient of the resistive layer at the at least one heating area, wherein the resistive layer at least overlaps with the buffer layer on the heating area, wherein the at least one heating area each has a length ranging from 10 to 100 micrometers and a width ranging from 10 to 100 micrometers, and the resistance coefficient of the buffer layer at the at least one heating area is 1.5 to 15 times of the resistance coefficient of the resistive layer at the at least one heating area:

a conductive layer formed on the buffer layer and partially covered the resistive layer to expose the at least one heating area; and a protective layer covering above the conductive layer and the at least one heating area.

16. The thermal inkjet printhead chip structure as claimed in claim 15, wherein the sum of contact resistances of portions of the buffer layer and the resistive layer directly above each of the at least one driver circuitry is smaller than or equal to 3 percentages of the resistance of the resistive layer at each of the at least one heating area.

17. The thermal inkjet printhead chip structure as claimed in claim 15, wherein the resistive layer is formed intermediately above the buffer layer and an entire bottom of the resistive layer is covered by the buffer layer.

18. The thermal inkjet printhead chip structure as claimed in claim 17, wherein the openings comprise a first contact opening and a second contact opening, the drain and the source are exposed at the first contact opening and the second contact opening respectively, the buffer layer covers the drain and the source at the first contact opening and the second contact opening, the resistive layer is electrically connected to the drain and the source through the buffer layer at the first contact opening and the second contact opening.

* * * * *